US011719512B2

(12) United States Patent
Jiang et al.

(10) Patent No.: US 11,719,512 B2
(45) Date of Patent: Aug. 8, 2023

(54) REMOTE CONTROL GUN

(71) Applicant: CHINA INTELLIGENT BUILDING & ENERGY TECHNOLOGY CO., LTD., Beijing (CN)

(72) Inventors: Yang Jiang, Beijing (CN); Xulai Jiang, Beijing (CN)

(73) Assignee: China Intelligent Building & Energy Technology Co., Ltd., Beijing (CN)

( * ) Notice: Subject to any disclaimer, the term of this patent is extended or adjusted under 35 U.S.C. 154(b) by 40 days.

(21) Appl. No.: 16/310,628

(22) PCT Filed: May 22, 2017

(86) PCT No.: PCT/CN2017/085326
§ 371 (c)(1),
(2) Date: Dec. 17, 2018

(87) PCT Pub. No.: WO2018/213979
PCT Pub. Date: Nov. 29, 2018

(65) Prior Publication Data
US 2019/0145739 A1 May 16, 2019

(51) Int. Cl.
*F41G 5/06* (2006.01)
*F41A 19/08* (2006.01)
(Continued)

(52) U.S. Cl.
CPC ..... *F41G 5/06* (2013.01); *F41A 19/08* (2013.01); *F41A 19/58* (2013.01); *F41A 23/24* (2013.01); *F41A 27/28* (2013.01); *F41G 3/165* (2013.01)

(58) Field of Classification Search
CPC .. F41A 19/08; F41A 23/24; F41G 3/16; F41G 3/165; F41G 3/2605; F41G 5/06
(Continued)

(56) References Cited

U.S. PATENT DOCUMENTS 3,953,132 A * 4/1976 Michelsen ..... F41G 3/26 356/141.1
4,318,330 A * 3/1982 Hausenbias ..... F41G 3/22 89/41.05

(Continued)

FOREIGN PATENT DOCUMENTS

CN 200989749 Y 12/2007
CN 204902679 U 12/2015

(Continued)

OTHER PUBLICATIONS

International Search Report for PCT/CN2017/085326 dated Feb. 22, 208, all enclosed pages cited.

*Primary Examiner* — Joshua E Freeman
*Assistant Examiner* — Benjamin S Gomberg
(74) *Attorney, Agent, or Firm* — Burr & Forman LLP

(57) ABSTRACT

The present application provides a remote-controlled gun, comprising a gun base, a gun body, an angle adjustment device, a camera, and a remote controller, wherein the angle adjustment device is connected with the gun body and the gun base, and configured for adjusting a pitch shooting angle of the gun body with respect to the gun base in a vertical plane and a left and right swing angle of the gun body with respect to the gun base in a horizontal plane; the camera is configured for monitoring a shooting target and a front sight of the gun body; the remote controller is connected with the camera and configured for displaying a monitoring image of the camera; and the remote controller is also connected with the angle adjustment device and configured for controlling the gun body to rotate with respect to the gun base until the front sight is aligned with the shooting target within a monitoring area; and the remote controller is also connected with the gun body, and configured for controlling the shooting of the gun body. Compared with the prior arts, this remote-controlled gun makes the user's shooting behavior be changed from operation at site to remote operation, which greatly increases the safety of use; the flexibility of operation be greatly increased, the user can concentrate on a screen of the remote controller to find a target; the aiming be improved, without the need to aim by a naked eye and manual firing, reducing effects due to human factors.

12 Claims, 3 Drawing Sheets

(51) Int. Cl.

| | |
|---|---|
| ***F41A 23/24*** | (2006.01) |
| ***F41A 19/58*** | (2006.01) |
| *F41G 3/16* | (2006.01) |
| *F41A 27/28* | (2006.01) |

(58) Field of Classification Search
USPC ..... 89/41.05
See application file for complete search history.

(56) References Cited

U.S. PATENT DOCUMENTS

| | | | | |
|---|---|---|---|---|
| 5,822,713 | A * | 10/1998 | Profeta | F41G 3/02 701/302 |
| 6,237,462 | B1 * | 5/2001 | Hawkes | F41A 23/12 89/37.05 |
| 8,104,216 | B2 * | 1/2012 | Uhm | F41A 17/46 42/111 |
| 8,516,943 | B2 | 8/2013 | Rogers | |
| 8,561,519 | B2 * | 10/2013 | Karakookly | F41A 23/24 89/127 |
| 8,833,231 | B1 * | 9/2014 | Venema | F41G 3/16 89/41.07 |
| 2008/0034954 | A1 * | 2/2008 | Grober | F41A 23/14 89/41.05 |
| 2011/0288804 | A1 * | 11/2011 | Lee | F41G 3/326 702/87 |
| 2020/0326156 | A1 * | 10/2020 | McNeil | F41G 3/02 |

FOREIGN PATENT DOCUMENTS

| | | | |
|---|---|---|---|
| CN | 105890447 | A | 8/2016 |
| CN | 205561646 | U | 9/2016 |
| CN | 205679125 | U | 11/2016 |
| WO | 2007/086874 | A2 | 8/2007 |

* cited by examiner

REMOTE CONTROL GUN

TECHNICAL FIELD

The present application relates to the technical field of guns, and in particular to a remote-controlled gun.

BACKGROUND

At present, users usually need to hold guns in hands to shoot at site, such that the use of guns in this way is extremely dangerous.

In view of this, how to improve the safety of the use of guns is an urgent technical problem to be solved by those skilled in the art.

SUMMARY

The purpose of embodiments of the present application is to provide a remote-controlled gun to improve the safety of use of guns. The specific technical solutions are as follows.

The remote-controlled gun provided by the present application includes a gun base, a gun body, an angle adjustment device, a camera, and a remote controller.

The angle adjustment device is connected with the gun body and the gun base, and configured for adjusting a pitch shooting angle of the gun body with respect to the gun base in a vertical plane and a left-right shooting angle of the gun body with respect to the gun base in a horizontal plane.

The camera is configured for monitoring a shooting target and a front sight of the gun body.

The remote controller is connected with the camera and configured for displaying a monitoring image of the camera; and also connected with the angle adjustment device and configured for controlling the gun body to rotate with respect to the gun base until the front sight is aligned with the shooting target; and also configured for controlling the shooting of the gun body.

Optionally, the remote controller includes:

a display screen, configured for displaying a monitoring image of the camera;

an angle adjustment button, configured for controlling the gun body to rotate with respect to the gun base until the front sight is aligned with the shooting target;

a shot triggering button, configured for controlling the shooting of the gun body;

a firing safety switch, configured for controlling the gun body to be in a locked state or a standby state.

Optionally, the camera includes a first camera and a second camera.

The first camera is configured for monitoring a preset monitoring area, the number of the first cameras is at least one, and the second camera is fixedly secured at the barrel of the gun body.

Optionally, the remote controller includes:

a display screen, configured for displaying a monitoring image of the first camera and a monitoring image of the second camera;

an angle adjustment button, configured for controlling the gun body to rotate with respect to the gun base until the front sight is aligned with the shooting target;

a shot triggering button, configured for controlling the shooting of the gun body;

a firing safety switch, configured for controlling the gun body to be in a locked state or a standby state.

Optionally, the remote controller and the camera are wirelessly connected.

Optionally, the remote controller and the gun body are wirelessly connected.

Optionally, a lifting adjustment device is further included for adjusting the lifting and lowering of the gun body with respect to the gun base in the vertical plane.

Optionally, the lifting adjustment device includes a lifting platform and a hydraulic cylinder.

The angle adjustment device is connected with the gun base through the lifting platform, the hydraulic cylinder is vertically disposed, a cylinder body of the hydraulic cylinder is fixedly connected with the gun base, and a piston rod of the hydraulic cylinder is fixedly connected with the lifting platform.

Optionally, the angle adjustment device includes two sub-angle adjustment devices.

Each of the sub-angle adjustment devices comprises a bottom plate, a first vertical plate, a second vertical plate, a first hinge plate, a second hinge plate, a motor, a threaded rod, a nut, a first hinge shaft, and a second hinge shaft and a third hinge shaft;

The first vertical plate and the second vertical plate are disposed in parallel and both fixedly secured at the bottom plate, the threaded rod is pivotally connected with the second vertical plate and in threaded connection with the nut, the motor is fixedly mounted at the bottom plate and configured for driving the threaded rod to rotate; the first vertical plate and the first hinge plate are hinged by the first hinge shaft, the first hinge plate and the second hinge plate are hinged by the second hinge shaft, the second hinge plate and the nut are hinged by the third hinge shaft, and the first hinge shaft, the second hinge shaft and the third hinge shaft are parallel to each other;

Axes of the first hinge shaft, the second hinge shaft, and the third hinge shaft of one of the two sub-angle adjustment devices all extend in a vertical direction, and the bottom plate is fixedly connected with the gun base;

Axes of the first hinge shaft, the second hinge shaft, and the third hinge shaft of the other one of the two sub-angle adjustment devices all extend in a horizontal direction, the first hinge plate of this sub-angle adjustment device is fixedly connected with the gun body, and the bottom plate of this sub-angle adjustment device is fixedly connected with the first hinge plate of the other sub-angle adjustment device.

Optionally, the first camera and the gun body are separately disposed, or the first camera is mounted at a high place overlooking the monitoring area or other concealed places according to actual monitoring requirements.

The remote-controlled gun provided by the present application comprises a gun base, a gun body, an angle adjustment device, a plurality of cameras, and a remote controller.

The angle adjustment device is connected with the gun body and the gun base, and configured for adjusting a pitch shooting angle of the gun body with respect to the gun base in a vertical plane and a left-right shooting angle of the gun body with respect to the gun base in a horizontal plane.

The plurality of cameras are configured for monitoring a shooting target.

The remote controller is connected with the plurality of cameras and configured for displaying monitoring images of the plurality of cameras and obtaining coordinates of the shooting target based on the monitoring images of the plurality of cameras; and also connected with the angle adjustment device and configured for controlling the gun body to rotate with respect to the gun base until the front sight is aligned with the shooting target based on the obtained coordinates of the shooting target; and also configured for controlling the shooting of the gun body.

Optionally, the remote controller comprises:

a display screen, configured for displaying a monitoring image of the camera;

an angle adjustment unit, configured for controlling the gun body to rotate with respect to the gun base until the front sight is aligned with the shooting target;

a shot triggering button, configured for controlling the shooting of the gun body;

a firing safety switch, configured for controlling the gun body to be in a locked state or a standby state.

Optionally, the plurality of cameras are configured for monitoring a preset monitoring area, and are mounted at a high place overlooking the monitoring area or other concealed places according to actual monitoring requirements, or are fixedly secured at a barrel of the gun body.

Optionally, the remote controller and the camera are wirelessly connected.

Optionally, the remote controller and the gun body are wirelessly connected.

Optionally, the remote controller further comprises a lifting adjustment device configured for adjusting the lifting and lowering of the gun body with respect to the gun base in the vertical plane.

Optionally, the lifting adjustment device comprises a lifting platform and a hydraulic cylinder.

The angle adjustment device is connected with the gun base through the lifting platform, the hydraulic cylinder is vertically disposed, a cylinder body of the hydraulic cylinder is fixedly connected with the gun base, and a piston rod of the hydraulic cylinder is fixedly connected with the lifting platform.

Optionally, the angle adjustment device comprises two sub-angle adjustment devices, each of the sub-angle adjustment devices comprises a bottom plate, a first vertical plate, a second vertical plate, a first hinge plate, a second hinge plate, a motor, a threaded rod, a nut, a first hinge shaft, and a second hinge shaft and a third hinge shaft.

The first vertical plate and the second vertical plate are disposed in parallel and both fixedly secured at the bottom plate, the threaded rod is pivotally connected with the second vertical plate and in threaded connection with the nut, the motor is fixedly mounted at the bottom plate and configured for driving the threaded rod to rotate; the first vertical plate and the first hinge plate are hinged by the first hinge shaft, the first hinge plate and the second hinge plate are hinged by the second hinge shaft, the second hinge plate and the nut are hinged by the third hinge shaft, and the first hinge shaft, the second hinge shaft and the third hinge shaft are parallel to each other.

Axes of the first hinge shaft, the second hinge shaft, and the third hinge shaft of one of the two sub-angle adjustment devices all extend in a vertical direction, and the bottom plate thereof is fixedly connected with the gun base.

Axes of the first hinge shaft, the second hinge shaft, and the third hinge shaft of the other one of the two sub-angle adjustment devices all extend in a horizontal direction, the first hinge plate of this sub-angle adjustment device is fixedly connected with the gun body, and the bottom plate of this sub-angle adjustment device is fixedly connected with the first hinge plate of the other sub-angle adjustment device.

The remote-controlled gun provided by the embodiments of the present application comprises a gun base, a gun body, an angle adjustment device, a camera, and a remote controller, wherein the angle adjustment device is connected with the gun body and the gun base, and configured for adjusting a pitch shooting angle of the gun body with respect to the gun base in a vertical plane and a left and right swing angle of the gun body with respect to the gun base in a horizontal plane; the camera is configured for monitoring a shooting target; the remote controller is connected with the camera and configured for displaying a monitoring image of the camera; and the remote controller is also connected with the angle adjustment device and configured for controlling the gun body to rotate with respect to the gun base until the front sight is aligned with the shooting target within a monitoring area; and the remote controller is also connected with the gun body and configured for controlling the shooting of the gun body.

In actual uses, the user only needs to dispose or fixedly mount the gun body at a selected position, and pre-select and aim at a general direction in which the shooting target may appear. The shooting target captured by the camera is transmitted to the remote controller and displayed, and the user controls the angle adjustment device to adjust the position of the gun body with respect to the gun base through the remote controller, so as to make the front sight of the gun body to be aligned with the shooting target, and finally the remote controller triggers the shooting of the gun body.

Compared with the guns in the prior art, the advantages of this remote-controlled gun are as follows.

1. The user's shooting behavior is changed from operation at site to remote operation, which greatly increases the safety of use.

2. The flexibility of operation is greatly increased, the user can concentrate on a screen of the remote controller to find a target, and even can carry out a variety of actions such as eating, communication, or the like.

3. The separation between a human and a gun is implemented, which reduces the complexity of the setting of a shelter or even eliminate the shelter.

4. The aiming is improved, without the need to aim by a naked eye and manual firing, reducing the adverse effects from human factors.

5. The concealability of shooting is improved, the remote-controlled gun can be disposed in various concealed positions such as a roof, a shrub or a corner, after the target appears, then the gun base is controlled to rise (or descend) out of the barrel for shooting, which is extremely difficult to be discovered by the other party.

6. The environmental adaptability is greatly improved, and the remote-controlled gun can be deployed in a small concealed environment and in an environment where food, water, air are harsh or even lack of.

BRIEF DESCRIPTION OF THE DRAWINGS

The drawings of the description that constitute a part of the present application are used to provide a further understanding of the present application. The exemplary embodiments of the present application and the descriptions thereof are used to explain the present application, and do not constitute improper limitations on the application. In the drawings.

Wherein, the correspondence between the name and the reference sign of each component in FIGS. 1 to 6 is:

00 gun base;

01 gun body: 011 barrel, 012 front sight;

02 angle adjustment device:

1 bottom plate, 2 first vertical plate, 3 second vertical plate, 4 first hinge plate, 5 second hinge plate, 6 motor, 7 threaded rod, 8 nut, 9 first hinge shaft, 10 second hinge shaft, 11 third hinge shaft;

03 camera;

04 remote controller: 041 display screen, 042 angle adjustment button, 043 shot triggering button, 044 firing safety switch;

lifting adjustment device: 051 lifting platform, 052 cylinder body, 053 piston rod.

DETAILED DESCRIPTION

The technical solutions in the embodiments of the present application will be clearly and completely described in the following with reference to the drawings in the embodiments of the present application. Obviously, the described embodiments are only some, and not all, of the embodiments of the present application. All other embodiments obtained based on the embodiments of the present application by those skilled in the art without any creative efforts fall into the scope of protection defined by the present application.

It should be noted that a horizontal plane and a vertical plane mentioned herein are set based on the bottom surface of a gun base. The bottom surface of the gun base is usually a plane, and a plane parallel to the bottom surface of the gun base is a horizontal plane, a plane perpendicular to the bottom surface of the gun base is a vertical plane.

Figure 1:
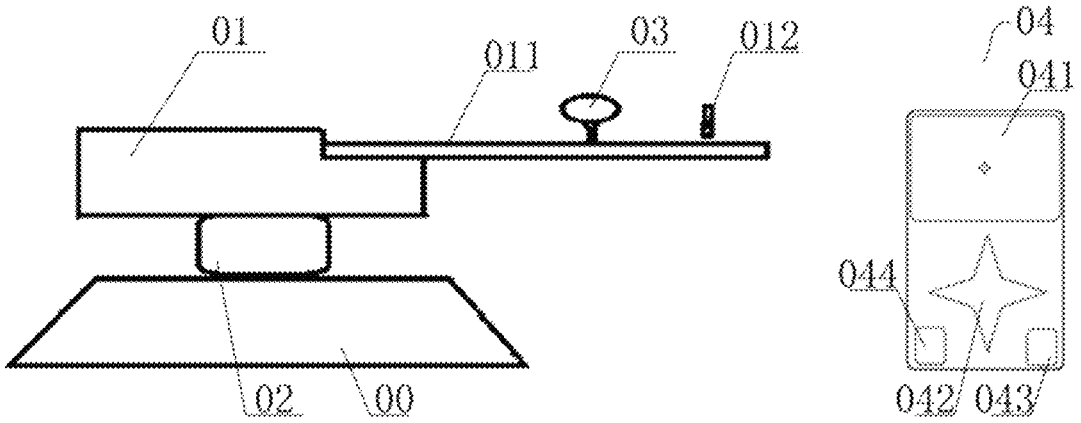
FIG. 1 is a schematic structural diagram of a first specific embodiment of a remote-controlled gun provided by the present application.

Please refer to FIG. 1, which is a schematic structural diagram of a first specific embodiment of a remote-controlled gun provided by the present application.

The remote-controlled gun provided by this embodiment includes a gun base 00, a gun body 01, an angle adjustment device 02, a camera 03, and a remote controller 04.

The angle adjustment device 02 is connected with the gun base 00 and the gun body 01, and configured for adjusting a pitch shooting angle of the gun body 01 with respect to the gun base 00 in the vertical plane and a left-right shooting angle of the gun body 01 with respect to the gun base 00 in the horizontal plane; the camera 03 is configured for monitoring a shooting target and a front sight 012 of the gun body 01; the remote controller 04 is connected with the camera 03 configured for displaying a monitoring image of the camera 03; the remote controller 04 is also connected with the angle adjustment device 02 configured for controlling the movement of the gun body 01 relative to the gun base 00 until the front sight 012 is aligned with the shooting target; the remote controller 04 is also connected with the gun body 01 and configured for controlling the shooting of the gun body 01.

Specifically, the gun body 01 includes a gun housing, a magazine, an automatic loading device, and an automatic shooting device; wherein the gun housing and the magazine are connected by the automatic loading device to load a bullet in the magazine into the automatic shooting device, and the automatic shooting device is connected with the remote controller 04, and thus the user can trigger the shooting of the automatic shooting device by pressing a shot triggering button 043 of the remote controller 04.

The angle adjustment device 02 is connected with the gun body 01 and the gun base 00 to adjust the pitch shooting angle of the gun body 01 with respect to the gun base 00 in the vertical plane and the left-right shooting angle of the gun body 01 with respect to the gun base 00 in the horizontal plane.

In one example, there are a plurality of cameras 03. The cameras are configured for monitoring a shooting target. The remote controller 04 is configured for displaying monitoring images of the plurality of cameras 03 and obtaining coordinates of the shooting target based on the monitoring images of the plurality of cameras 03; and also connected with the angle adjustment device 02 and configured for controlling the gun body 01 to rotate with respect to the gun base 00 until the front sight is aligned with the shooting target based on the obtained coordinates of the shooting target; and also configured for controlling the shooting of the gun body 01.

In one example, the plurality of cameras 03 are configured for monitoring a preset monitoring area, and are mounted at a high place overlooking the monitoring area or other concealed places according to actual monitoring requirements, or are fixedly secured at a barrel of the gun body 01.

In order to reduce the manufacturing cost, the angle adjustment device 02 in the present embodiment includes two sub-angle adjustment devices. These two sub-angle adjustment devices are identical in structure, but differ in the assembly relationship between the two and the gun body 01 and between the two and the gun base 00.

Figure 2:
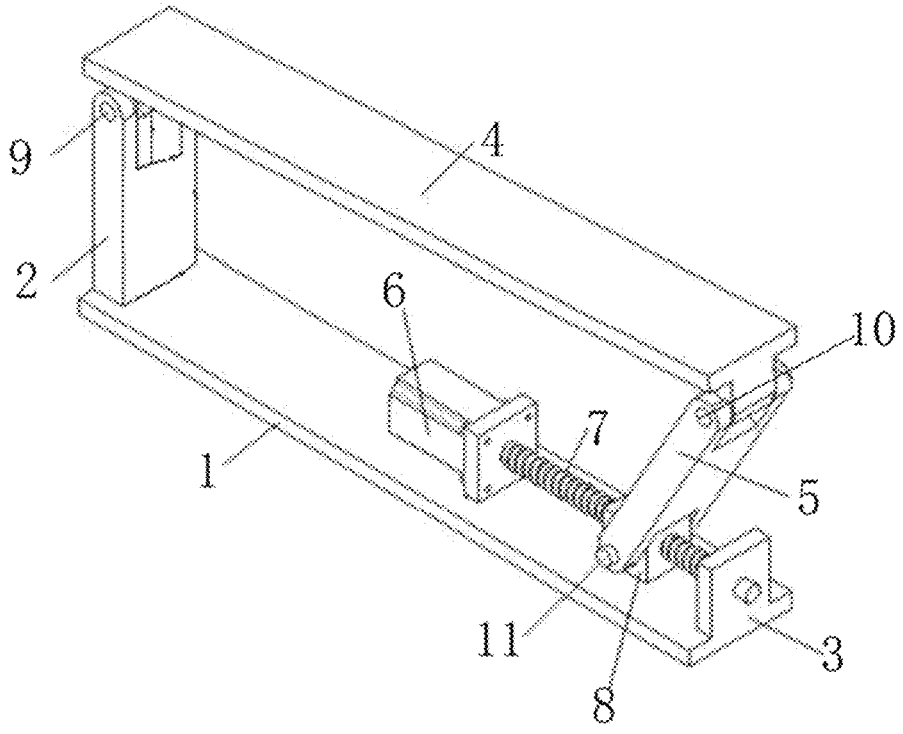
FIG. 2 is a schematic structural diagram of a sub-angle adjustment device.

Please refer to FIG. 2 in detail, which is a schematic structural diagram of a sub-angle adjustment device.

Each of the sub-angle adjustment devices includes a bottom plate 1, a first vertical plate 2, a second vertical plate 3, a first hinge plate 4, a second hinge plate 5, a motor 6, a threaded rod 7, a nut 8, a first hinge shaft 9, and a second hinge shaft 10 and a third hinge shaft 11.

The first vertical plate 2 and the second vertical plate 3 are arranged in parallel and both fixed to the bottom plate 1. The threaded rod 7 is pivotally connected to the second vertical plate 3 and in threaded connection with the nut 8. The motor 6 is fixedly mounted at the bottom plate 1 and configured for driving the threaded rod 7 to rotate about its own axis. The first vertical plate 2 and the first hinge plate 4 are hinged by the first hinge shaft 9, the first hinge plate 4 and the second hinge plate 5 are hinged by the second hinge shaft 10, the second hinge plate 5 and the nut 8 are hinged by the third hinge shaft 11, and the first hinge shaft 9, the second hinge shaft 10 and the third hinge shaft 11 are parallel to each other.

The working principle of the sub-angle adjustment device is: starting the motor 6, an armature shaft of the motor 6 drives the threaded rod 7 to rotate about its own axis, and the rotation of the threaded rod 7 drives the nut 8 to linearly move along the axis of the threaded rod 7, at the same time, the second hinge plate 5 pushes the first hinge plate 4 to rotate about the first hinge shaft 9, and the rotation direction of the first hinge plate 4 about the first hinge shaft 9 is controlled by the rotation direction of the motor 6, that is, changing the rotation direction of the motor 6 can adjust the rotation direction of the first hinge plate 4 about the first hinge shaft 9.

Figure 3:
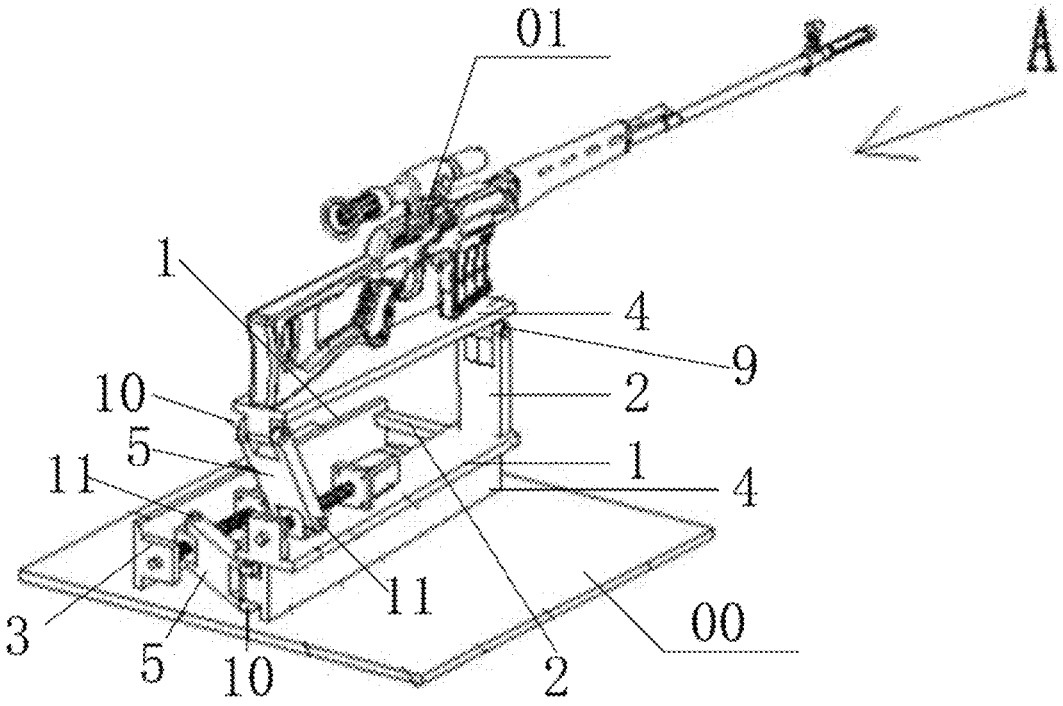
FIG. 3 is a schematic structural diagram of a second specific embodiment of a remote-controlled gun provided by the present application.
Figure 4:
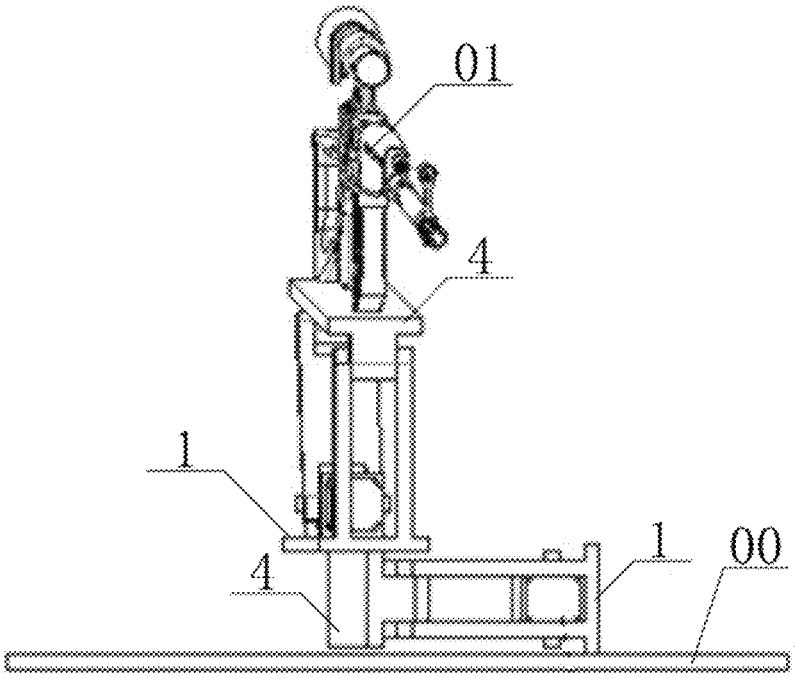
FIG. 4 is a schematic structural diagram of the remote-controlled gun shown in FIG. 3 in A direction.

Refer to FIG. 3, which is a schematic structural diagram of a second specific embodiment of the remote-controlled gun provided by the present application.

The axes of the first hinge shaft 9, the second hinge shaft 10, and the third hinge shaft 11 of one of the two sub-angle adjustment devices 0 all extend in the vertical direction, and the bottom plate 1 thereof is fixedly connected with the gun base 00.

The axes of the first hinge shaft 9, the second hinge shaft 10 and the third hinge shaft 11 of the other one of the two sub-angle adjustment devices 0 all extend in the horizontal direction, and the first hinge plate 4 thereof is fixedly connected with the gun body 01, and the bottom plate 1 thereof is fixedly connected with the first hinge plate 4 of the other sub-angle adjustment device 02. In order to facilitate a better understanding of the specific structure of the remote-controlled gun in the present embodiment, please refer to FIG. 4 together, which is a schematic structural diagram of FIG. 3 in A direction.

In actual uses, when the remote controller 04 controls the rotation of the motor 6 of the sub-angle adjustment device in which the first hinge shaft 9, the second hinge shaft 10 and the third hinge shaft 11 all extend in the vertical direction, the first hinge plate 4 thereof will drive the other sub-angle adjustment device and the gun body 01 to swing left and right around the first hinge shaft 9 with respect to the gun base 00 in the horizontal plane, thereby achieving the purpose of adjusting the left-right shooting angle of the gun body 01 with respect to the gun base 00 in the horizontal plane.

Similarly, when the remote controller 04 controls the rotation of the motor 6 of the sub-angle adjustment device in which the first hinge shaft 9, the second hinge shaft 10 and the third hinge shaft 11 all extend in the horizontal direction, the first hinge plate 4 thereof will drive the other sub-angle adjustment device and the gun body 01 to swing up and down around the first hinge shaft 9 with respect to the gun base 00 in the horizontal plane, thereby achieving the purpose of adjusting the pitch shooting angle of the gun body 01 with respect to the gun base 00 in the vertical plane.

It can be seen that the present embodiment adopts two sub-angle adjustment devices of the same structure, skillfully implementing the adjustment of the left-right shooting angle of the gun body 01 with respect to the gun base 00 in the horizontal plane, and the adjustment of the pitch shooting angle of the gun body 01 with respect to the gun base 00 in the vertical plane. The structure is simple and easy to process.

Continuing to refer to FIG. 1, the remote controller 04 in this embodiment includes a display screen 041, a shooting angle adjustment button 042, a shot triggering button 043, and a firing safety switch 044.

The display screen 041 is configured for displaying the monitoring image of the camera 03; the angle adjustment button 042 is configured for adjusting the pitch shooting angle of the gun body 01 with respect to the gun base 00 in the vertical plane and the left-right shooting angle of the gun body 01 with respect to the gun base 00 in the horizontal plane; the shot triggering button 043 is configured for controlling the shooting of the gun body 01; the firing safety switch 044 is configured for controlling the gun body 01 to be in a locked state or a standby state.

When the firing safety switch 044 is open, the gun body 01 is in the standby state, and the gun body 01 can be controlled to shoot by starting the shot triggering button 043. Conversely, when the firing safety switch 044 is closed, the gun body 01 is in the locked state, and the gun body 01 cannot be controlled to shoot even if the shot triggering button 043 is started, which can prevent the occurrence of a safety accident caused by the misoperation of the shot triggering button 043, and improve the safety of the remote-controlled gun.

The remote controller 04 and the camera 03 may be connected by wire or wirelessly; similarly, the remote controller 04 and the gun body 01 may also be connected by wire or wirelessly.

Further, in order to improve the concealability of the remote-controlled gun, when the shooting target has not appeared in the monitoring area, the remote-controlled gun may be completely hidden in a shelter such as a shrub. When the shooting target appears, the user controls the gun body to extend from the shelter through the remote controller and continues monitoring, and then controls the gun body to shoot when the shooting target and the front sight are aligned.

Figure 5:
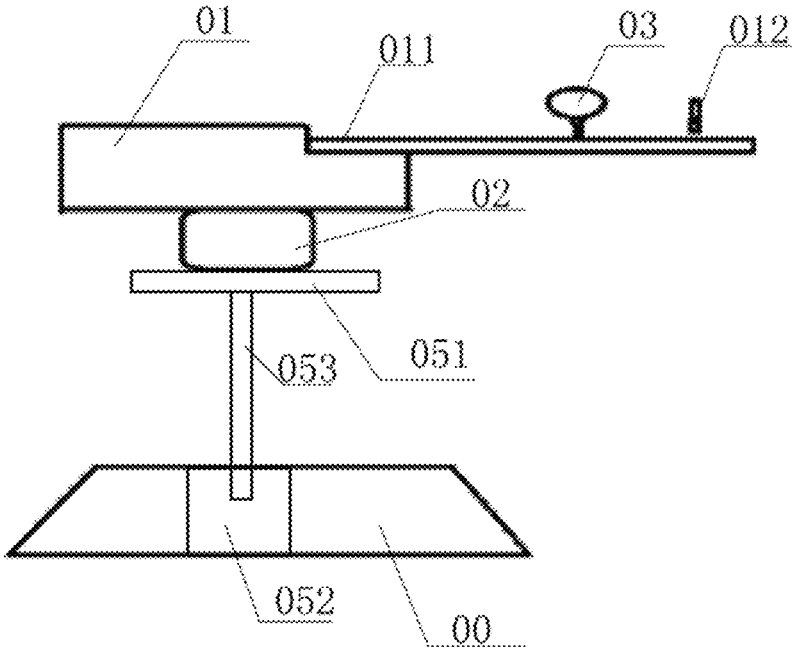
FIG. 5 is a schematic structural diagram of a third specific embodiment of a remote-controlled gun provided by the present application.

The remote-controlled gun also includes a lifting adjustment device configured for adjusting the lifting and lowering of the gun body with respect to the gun base. Refer to FIG. 5 in detail, which is a schematic structural diagram of a third specific embodiment of the remote-controlled gun provided by the present application.

In detail, the lifting adjustment device includes a lifting platform 051 and a hydraulic cylinder; wherein the second vertical plate 3 of the angle adjustment device 02 is fixedly connected with the lifting platform 051, the hydraulic cylinder is vertically disposed, a cylinder body 052 thereof is fixedly connected with the gun base 00, and a piston rod 053 thereof is fixedly connected with the lifting platform 051.

Starting the hydraulic cylinder, the gun body 01 and the angle adjustment device 02 will move up and down with respect to the gun base along with the piston rod 053 of the hydraulic cylinder.

In actual uses, the user only needs to dispose or fixedly mount the gun body 01 at a selected position, and pre-select and aim at a general direction in which the shooting target may appear. The shooting target captured by the camera 03 is transmitted to the remote controller 04 and displayed, and the user controls the angle adjustment device 02 and the lifting adjustment device to adjust the position of the gun body 01 with respect to the gun base 00 through the remote controller 04, so as to make the front sight 012 of the gun body 01 to be aligned with the shooting target, and finally the remote controller 04 triggers the shooting of the gun body 01.

Further, in the third embodiment provided by the present application, the remote-controlled gun includes a first camera and a second camera; wherein both the first camera and the second camera are communicatively connected with the remote controller 04. The first camera is configured for monitoring a preset monitoring area. The number of the first cameras is at least one, that is, the number of the first cameras can be 1, 2, 3 or any positive integer, so as to monitor images in different directions. The second camera is fixedly secured at a barrel 011 of the gun body 01, configured for monitoring the front sight and targets. Since the first camera and the gun body are separately disposed, the user can mount the first camera at a high place overlooking the monitoring area or other concealed places according to actual monitoring requirements, so as to achieve the effect of monitoring a large coverage or increased concealability. As long as the shooting target appears at any position within the monitoring area of the first camera, the angle adjustment device 02 and the lifting adjustment device are controlled by the remote controller to adjust the position of the gun body 01 with respect to the gun base 00, and the second camera is configured for observation so as to make the front sight

012 of the gun body 01 to be aligned with the shooting target, and finally the remote controller 04 triggers the shooting of the gun body 01.

Figure 6:
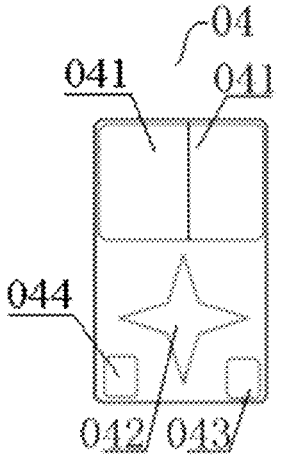
FIG. 6 is a schematic structural diagram of an embodiment of a remote controller.

For the remote-controlled gun including the first camera and the second camera, in order to facilitate the user to better observe the monitoring images transmitted by the two cameras, referring to a schematic structural diagram of a specific embodiment of the remote controller shown in FIG. 6, the remote controller of the remote-controlled gun provided by the third embodiment includes two display screens 041, a shooting angle adjustment button 042, a shot triggering button 043, and a firing safety switch 044.

One of the two display screens 041 is configured for displaying a monitoring image of the first camera, and the other one is configured for displaying a monitoring image of the second camera; the angle adjustment button 042 is configured for adjusting the pitch shooting angle of the gun body 01 with respect to the gun base 00 in the vertical plane and the left-right shooting angle of the gun body 01 with respect to the gun base 00 in the horizontal plane; the shot triggering button 043 is configured for controlling the shooting of the gun body 01; the firing safety switch 044 is configured for controlling the gun body 01 to be in a locked state or a standby state.

When the firing safety switch 044 is open, the gun body 01 is in the standby state, and the gun body 01 can be controlled to shoot by starting the shot triggering button 043. Conversely, when the firing safety switch 044 is closed, the gun body 01 is in the locked state, and the gun body 01 cannot be controlled to shoot even if the shot triggering button 043 is started, which can prevent the occurrence of a safety accident caused by the misoperation of the shot triggering button 043, and improve the safety of the remote-controlled gun.

Compared with the guns in the prior art, the advantages of this remote-controlled gun are as follows.

1. The user's shooting behavior is changed from operation at site to remote operation, which greatly increases the safety of use.

2. The flexibility of operation is greatly increased, the user can concentrate on a screen of the remote controller 04 to find a target, and even can carry out a variety of actions such as eating, communication, or the like.

3. The separation between a human and a gun is implemented, which reduces the complexity of the setting of a shelter or even eliminate the shelter.

4. The aiming is improved, without the need to aim by a naked eye and manual firing, reducing the adverse effects from human factors.

5. The concealability of shooting is improved, the remote-controlled gun can be disposed in various concealed positions such as a roof, a shrub or a corner, after the target appears, then the gun base is controlled to rise (or descend) out of the barrel for shooting, which is extremely difficult to be discovered by the other party.

6. The environmental adaptability is greatly improved, and the remote-controlled gun can be deployed in a small concealed environment and in an environment where food, water, air are harsh or even lack of.

The embodiments described above are simply preferable embodiments of the present application, and are not intended to limit the present application. For those skilled in the art, various modifications and changes can be made to the present application. Any modifications, alternatives, improvements, or the like made within the spirit and principle of the present application shall be included within the scope of protection of the present application.

What is claimed is:

1. A remote-controlled gun, comprising: a gun base, a gun body, an angle adjustment device, a camera, and a remote controller, wherein the angle adjustment device is connected with the gun body and the gun base, and configured for adjusting a pitch shooting angle of the gun body with respect to the gun base in a vertical plane and a left-right shooting angle of the gun body with respect to the gun base in a horizontal plane;

the camera is configured for monitoring a shooting target and a front sight of the gun body; and the remote controller is connected with the camera and configured for displaying a monitoring image of the camera; and also connected with the angle adjustment device and configured for controlling the gun body to rotate with respect to the gun base until the front sight is aligned with the shooting target; and also configured for controlling shooting of the gun body;

wherein the camera comprises a plurality of first cameras configured for monitoring preset monitoring areas and a second camera, wherein the plurality of first cameras are disposed separately from and not directly or indirectly physically connected to the gun body, and mounted at places that are higher than and overlook the monitoring areas or concealed places that cannot be seen by the shooting target;

wherein the remote controller comprises two display screens, one of which is configured for displaying monitoring images of the first cameras and the other one of which is configured for displaying a monitoring image of the second camera; wherein the remote controller further comprises a shot triggering button configured for controlling the shooting of the gun body, an angle adjustment button configured for controlling the gun body to rotate with respect to the gun base until the front sight is aligned with the shooting target; wherein the display screens, the angle adjustment button, and the shot triggering button are incorporated into the remote controller as one integrated structure;

wherein the remote controller is configured to, when it is determined through an observation of the monitoring images from the first cameras that the shooting target appears at a position within a monitoring area of any one of the first cameras, adjust a position of the gun body with respect to the gun base through an observation of the monitoring image from the second camera so as to make the front sight of the gun body to be aligned with the shooting target, and finally trigger the shooting of the gun body;

wherein the remote controller comprises a firing safety switch, configured for controlling the gun body to be in a locked state or a standby state, wherein when the firing safety switch is open, the gun body is in the standby state, and the gun body can be controlled to shoot by starting the shot triggering button, when the firing safety switch is closed, the gun body is in the locked state, and the gun body cannot be controlled to shoot even if the shot triggering button is started;

wherein the second camera is fixedly secured at a barrel of the gun body, configured for monitoring the front sight and targets.

2. The remote-controlled gun of claim 1, wherein the remote controller and the cameras are wirelessly connected.

3. The remote-controlled gun of claim 1, wherein the remote controller and the gun body are wirelessly connected.

4. The remote-controlled gun of claim 1, further comprising: a lifting adjustment device configured for adjusting lifting and lowering of the gun body with respect to the gun base in the vertical plane.

5. The remote-controlled gun of claim 4, wherein the lifting adjustment device comprises a lifting platform and a hydraulic cylinder, the angle adjustment device is connected with the gun base through the lifting platform, the hydraulic cylinder is vertically disposed, a cylinder body of the hydraulic cylinder is fixedly connected with the gun base, and a piston rod of the hydraulic cylinder is fixedly connected with the lifting platform.

6. The remote-controlled gun of claim 1, wherein the angle adjustment device comprises two sub-angle adjustment devices, each of the two sub-angle adjustment devices comprises a bottom plate, a first vertical plate, a second vertical plate, a first hinge plate, a second hinge plate, a motor, a threaded rod, a nut, a first hinge shaft, and a second hinge shaft and a third hinge shaft;

the first vertical plate and the second vertical plate are disposed in parallel and both fixedly secured at the bottom plate, the threaded rod is pivotally connected with the second vertical plate and in threaded connection with the nut, the motor is fixedly mounted at the bottom plate and configured for driving the threaded rod to rotate; the first vertical plate and the first hinge plate are hinged by the first hinge shaft, the first hinge plate and the second hinge plate are hinged by the second hinge shaft, the second hinge plate and the nut are hinged by the third hinge shaft, and the first hinge shaft, the second hinge shaft and the third hinge shaft are parallel to each other;

axes of the first hinge shaft, the second hinge shaft, and the third hinge shaft of one of the two sub-angle adjustment devices all extend in a vertical direction, and the bottom plate thereof is fixedly connected with the gun base;

axes of the first hinge shaft, the second hinge shaft, and the third hinge shaft of the other one of the two sub-angle adjustment devices all extend in a horizontal direction, the first hinge plate of the other one of the two sub-angle adjustment devices is fixedly connected with the gun body, and the bottom plate of the other one of the two sub-angle adjustment devices is fixedly connected with the first hinge plate of the one of the two sub-angle adjustment devices.

7. A remote-controlled gun, comprising: a gun base, a gun body, an angle adjustment device, a plurality of cameras, and a remote controller, wherein the angle adjustment device is connected with the gun body and the gun base, and configured for adjusting a pitch shooting angle of the gun body with respect to the gun base in a vertical plane and a left-right shooting angle of the gun body with respect to the gun base in a horizontal plane;

the plurality of cameras are configured for monitoring a shooting target;

the remote controller is connected with the plurality of cameras and configured for displaying monitoring images of the plurality of cameras and obtaining coordinates of the shooting target based on the monitoring images of the plurality of cameras; and also connected with the angle adjustment device and configured for controlling the gun body to rotate with respect to the gun base until a front sight of the gun body is aligned with the shooting target based on the obtained coordinates of the shooting target; and also configured for controlling shooting of the gun body;

wherein the plurality of cameras are configured for monitoring a preset monitoring area, the plurality of cameras are disposed separately from and not directly or indirectly physically connected to the gun body, and are mounted at places that are higher than and overlook the monitoring area or concealed places that cannot be seen by the shooting target;

wherein the remote controller further comprises a shot triggering button configured for controlling the shooting of the gun body, an angle adjustment unit configured for controlling the gun body to rotate with respect to the gun base until the front sight is aligned with the shooting target, and a display screen configured for displaying the monitoring images of the plurality of cameras; wherein the display screen and the shot triggering button are incorporated into the remote controller as one integrated structure;

wherein the remote controller comprises a firing safety switch, configured for controlling the gun body to be in a locked state or a standby state, wherein when the firing safety switch is open, the gun body is in the standby state, and the gun body can be controlled to shoot by starting the shot triggering button, when the firing safety switch is closed, the gun body is in the locked state, and the gun body cannot be controlled to shoot even if the shot triggering button is started.

8. The remote-controlled gun of claim 7, wherein the remote controller and the cameras are wirelessly connected.

9. The remote-controlled gun of claim 7, wherein the remote controller and the gun body are wirelessly connected.

10. The remote-controlled gun of claim 7, further comprising: a lifting adjustment device configured for adjusting lifting and lowering of the gun body with respect to the gun base in the vertical plane.

11. The remote-controlled gun of claim 10, wherein the lifting adjustment device comprises a lifting platform and a hydraulic cylinder, the angle adjustment device is connected with the gun base through the lifting platform, the hydraulic cylinder is vertically disposed, a cylinder body of the hydraulic cylinder is fixedly connected with the gun base, and a piston rod of the hydraulic cylinder is fixedly connected with the lifting platform.

12. The remote-controlled gun of claim 7, wherein the angle adjustment device comprises two sub-angle adjustment devices, each of the two sub-angle adjustment devices comprises a bottom plate, a first vertical plate, a second vertical plate, a first hinge plate, a second hinge plate, a motor, a threaded rod, a nut, a first hinge shaft, and a second hinge shaft and a third hinge shaft;

the first vertical plate and the second vertical plate are disposed in parallel and both fixedly secured at the bottom plate, the threaded rod is pivotally connected with the second vertical plate and in threaded connection with the nut, the motor is fixedly mounted at the bottom plate and configured for driving the threaded rod to rotate; the first vertical plate and the first hinge plate are hinged by the first hinge shaft, the first hinge plate and the second hinge plate are hinged by the second hinge shaft, the second hinge plate and the nut are hinged by the third hinge shaft, and the first hinge shaft, the second hinge shaft and the third hinge shaft are parallel to each other;

axes of the first hinge shaft, the second hinge shaft, and the third hinge shaft of one of the two sub-angle adjustment devices all extend in a vertical direction, and the bottom plate thereof is fixedly connected with the gun base;

axes of the first hinge shaft, the second hinge shaft, and the third hinge shaft of the other one of the two sub-angle adjustment devices all extend in a horizontal direction, the first hinge plate of the other one of the two sub-angle adjustment devices is fixedly connected with the gun body, and the bottom plate of the other one of the two sub-angle adjustment devices is fixedly connected with the first hinge plate of the one of the two sub-angle adjustment devices.

* * * * *